US007329020B1

(12) United States Patent
Miller

(10) Patent No.: US 7,329,020 B1
(45) Date of Patent: Feb. 12, 2008

(54) ROTATABLE EARRINGS

(76) Inventor: Joan N. Miller, 1905 Constantine Dr., Marrero, LA (US) 70072

( * ) Notice: Subject to any disclaimer, the term of this patent is extended or adjusted under 35 U.S.C. 154(b) by 0 days.

(21) Appl. No.: 11/549,212

(22) Filed: Oct. 13, 2006

(51) Int. Cl.
*F21V 21/08* (2006.01)

(52) U.S. Cl. ..... 362/104; 362/571; 362/252

(58) Field of Classification Search ..... 362/104, 362/571, 252; 63/12–14.9, 31
See application file for complete search history.

(56) References Cited

U.S. PATENT DOCUMENTS 3,703,878 A 11/1972 Badovinac
3,968,357 A 7/1976 Hamilton
3,968,661 A 7/1976 Williams
4,052,864 A 10/1977 Hofsaess
D250,456 S 12/1978 Fishman
5,203,183 A * 4/1993 Salerno ..... 63/12

* cited by examiner

*Primary Examiner*—Sandra O'Shea
*Assistant Examiner*—Mark Tsidulko
(74) *Attorney, Agent, or Firm*—Advantia Law Group; Michael W. Starkweath; Jason P. Webb

(57) ABSTRACT

A rotatable earring for wearing and rotating. An embodiment of the earring includes: an elongated member, having a first and second end; a motor that provides rotation; a decorative member, configured to provide decoration; a coupling device, coupled to the motor, and selectably coupleable to an ear of a person; and a power module, coupled to the coupling device, in communication with the motor, and configured to provide power. According to other embodiments, the power module includes: a securing member configured to secure the power module to the coupling device; a battery configured to provide DC electricity; and an On/Off switch configured to control the release of power from the power module. Further, there is a light module, coupled to the decorative member, in communication with the power module, and configured to provide light.

9 Claims, 4 Drawing Sheets

ROTATABLE EARRINGS

BACKGROUND OF THE INVENTION

1. Field of the Invention

The present invention relates to jewelry such as earrings, specifically rotatable earrings.

2. Description of the Related Art

One skilled in the art would appreciate that individuals wear ornamental jewelry such as earrings to enhance their personal appearance, especially when attending business or social functions. However, there is a limited inventory of earrings in the marketplace that are designed to spin about a person's ear and light up during hours of darkness. Some improvements have been made in the field. Examples include but are not limited to the references described below, which references are incorporated by reference herein:

U.S. Pat. No. 3,968,661, issued to Williams, discloses an ornamental article for personal wear comprising a rotatable disc, the periphery of which is divided into a plurality of equal sections, each section having provided therein ornamentation having a horoscopic significance or the like, and fixed indicating means adapted to be aligned with any selected one of the sections, whereby the disc may be rotated until the desired section is aligned with the indicating means.

U.S. Pat. No. 3,968,357, issued to Hamilton, discloses a multi-facetted translucent ball surrounds a lamp which is suspended from an earring clip by a flexible tubular metal shaft which has a wire running there through. The earring clip is U-shaped and has a pair of opposed legs which are spread resiliently apart when the clip is engaged on ear with the lobe between the legs. One leg carries, connected to the wire, a cup for holding a wafer battery. A U-shaped support secured to the clip carries a contact opposite the cup in a position so that the cup is urged toward the contact for engaging opposite terminals of the battery upon spreading of the clip.

U.S. Pat. No. 4,052,864, issued to Hofsaess, discloses a mechanism operative to allow various jewelry settings mounted to a ring, bracelet, or locket to freely rotate in an oscillating manner about a fixed center point. The mechanism includes a mounting base member having a perpendicular mounting stem affixed thereto arranged to rotatably support a pendulum member having at least one pair of oppositely disposed magnets radially mounted thereto for rotation about the stem within the base member. Superposed above the pendulum and freely rotatable about the mounting stem is a platform to which various jewelry settings are mounted, the platform also including a pair of magnets which are radially aligned with the magnets of the pendulum so as to be rotatably activated by the movement of the pendulum, wherein the identical magnetic pole of each pair of magnets is juxtaposed, one above the other, causing a repulsing rotational action therebetween.

U.S. Pat. No. 5,203,183, issued to Salerno, discloses an earring of unitary construction having a rotatable element and a method of making the same. The earring includes a first ornamental portion which freely rotates about a ball bearing assembly fixedly attached to the first ornamental portion, a second ornamental portion disposed to the front of the first ornamental portion which remains fixed, and a bearing cap assembly disposed to the rear of the first ornamental portion which is fixedly attached to the second ornamental portion and includes a bearing cap which covers the ball bearing assembly, and an ear clasp for selective attachment of the earring to a wearer's ear.

U.S. Pat. No. 3,703,878, issued to Badovinac, discloses a pair of decorative earrings for being worn on a ladies ears, one of the earrings including an indicator to notify the wearer when her head is properly erect for a good posture, this earring including a horizontally extending chamber there-within that extends along a forward rearward direction, the chamber containing a small ball that is free to roll between opposite ends of the chamber and which when the head is properly erect for good posture rests at the rear end of the chamber; and when the posture becomes careless by inclining the head forwardly causes the small ball to roll toward a forward end of the chamber thus giving a sharp clicking sound so to warn the wearer to hold her head erect, the other earring not incorporating the indicator.

U.S. Design Pat. No.: D250,456, issued to Fishman, discloses the ornamental design for an earring.

The inventions heretofore known suffer from a number of disadvantages which include being: limited in versatility; unable to be selectably controlled and/or actuated by a switch; and/or unable to be configured to provide blinking or steady light.

What is needed is an earring that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available earrings. Accordingly, the present invention has been developed to provide a rotatable earring.

There is one embodiment of a rotatable earring for wearing and rotating. The earring may include: an elongated member, that may have a first end and/or second end; a motor, that may be rotatably coupled to the first end of the elongated member, and/or may be configured to provide rotation; a decorative member, that may be coupled to the second end of the elongated member, and/or may be configured to provide decoration; a coupling device, that may be coupled to the motor and/or may be selectably coupleable to an ear of a person; and a power module, that may be coupled to the coupling device, and/or may be in communication with the motor, and/or may be configured to provide power.

According to one embodiment of the present invention, the rotatable earring may include: a securing member that may be configured to secure the power module to the coupling device; a battery that may be configured to provide direct current (DC) electricity; and an On/Off switch configured to control the release of power from the power module.

According to another embodiment of the present invention, there is a light module that may be coupled to the decorative member, and/or may be in communication with the power module, and/or may be configured to provide light.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
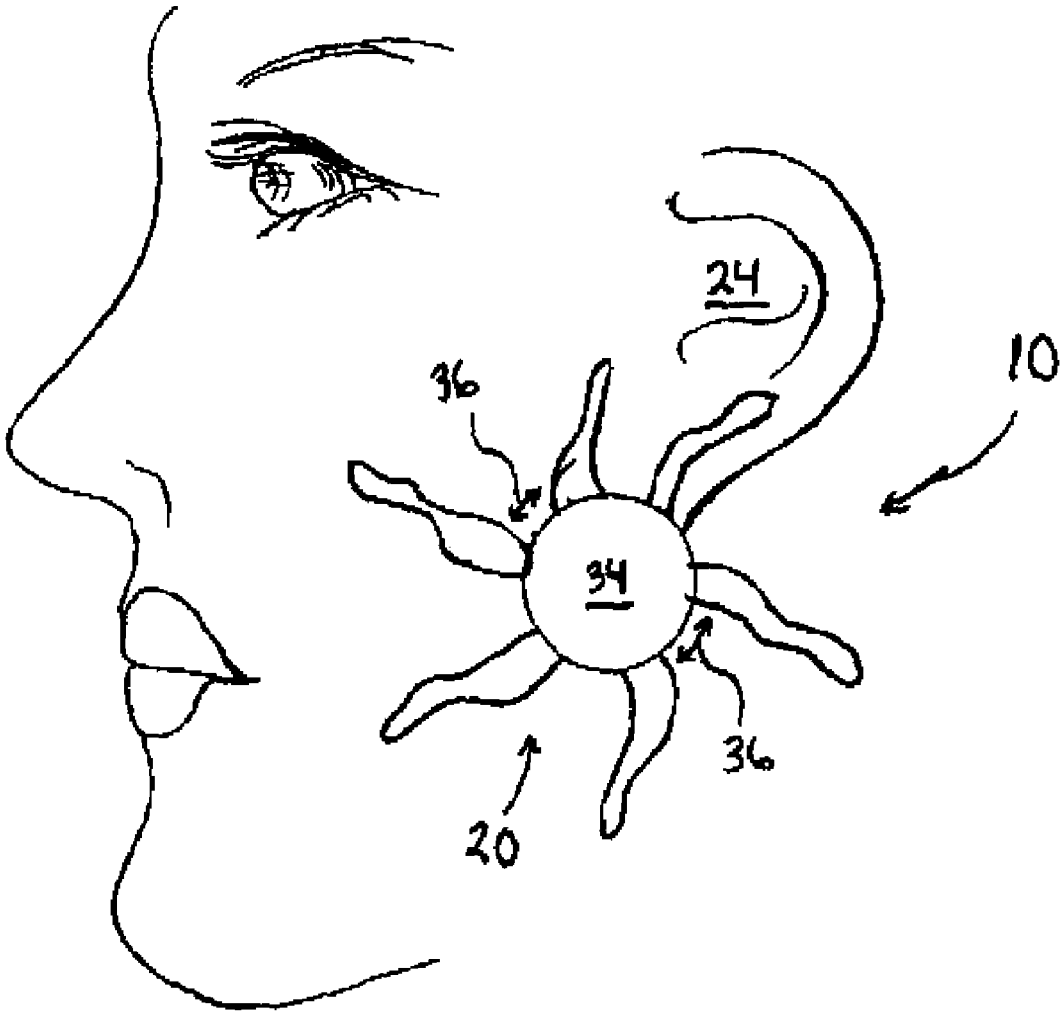
FIG. 1 is a front elevational view of a rotatable earring affixed to a person's ear, according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is, are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Figure 5:
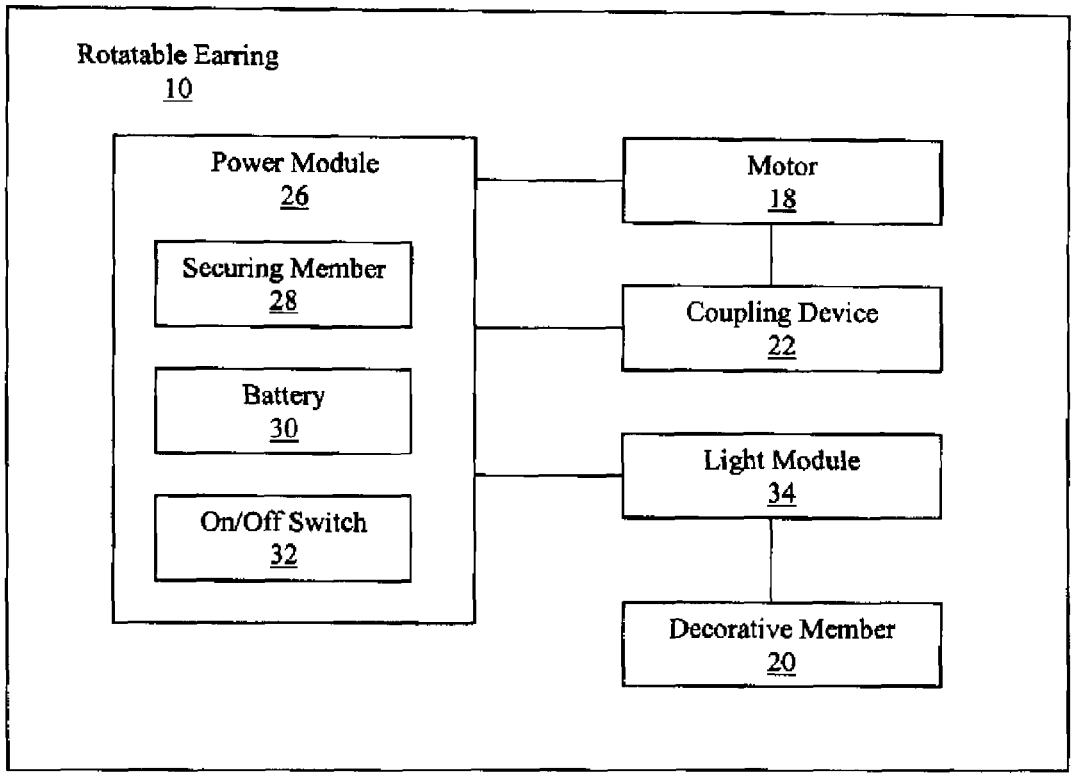
FIG. 5 is a block diagram of a rotatable earring, according to one embodiment of the invention.

Looking to the figures, there is one embodiment of a rotatable earring 10 for wearing and rotating about a user's ear. The earring, as shown, includes: an elongated member 12, having a first end 14 and second end 16; a motor 18 rotatably coupled to the first end of the elongated member, and configured to provide rotation about the elongated member; a decorative member 20 coupled to the second end of the elongated member, and configured to provide decoration; a coupling device 22 coupled to the motor and selectably coupleable to an ear of a person 24; and a power module 26, as shown in FIG. 5, coupled to the coupling device, in electrical communication with the motor, and configured to provide mechanical power to the motor to earrings. A non-limiting example of the functionality of the power module is described in U.S. Pat. No. 3,968,357, issued to Hamilton, which is incorporated by reference herein.

Figure 2:
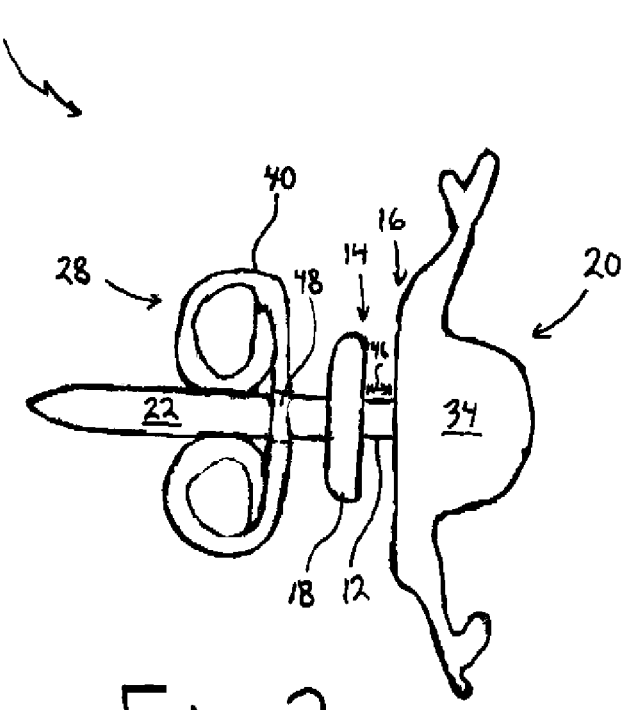
FIG. 2 is a left side elevational view of a rotatable earring, according to one embodiment of the invention.
Figure 3:
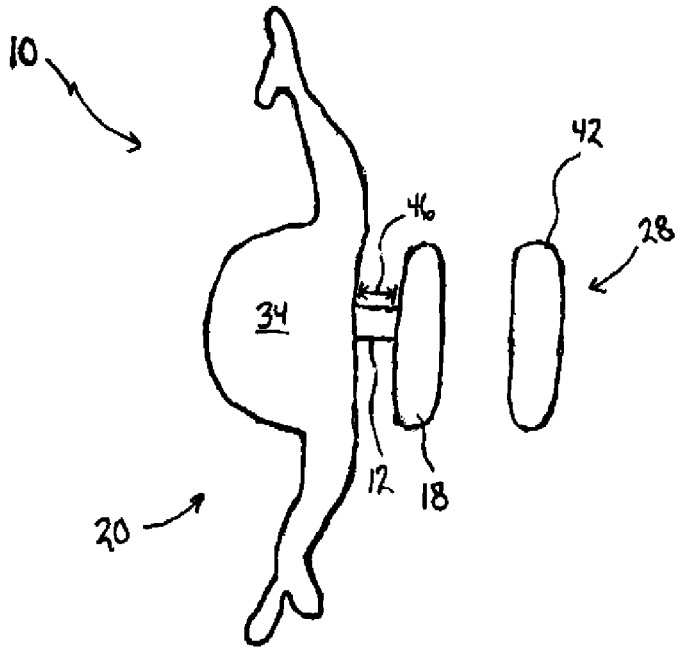
FIG. 3 is a right side elevational view of a rotatable earring, according to one embodiment of the invention.
Figure 4:
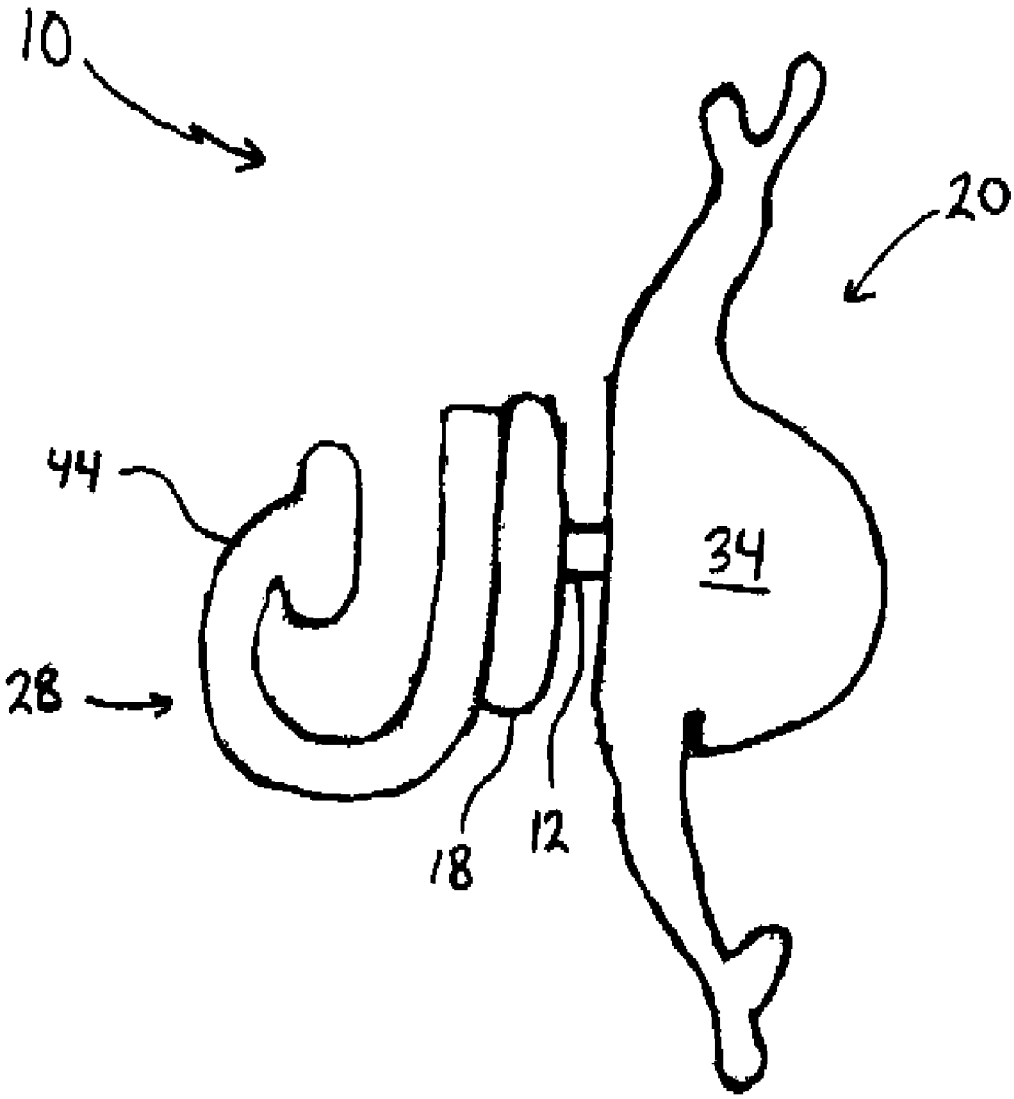
FIG. 4 is a left side elevational view of a rotatable earring, according to one embodiment of the invention.

FIGS. 1 and 2 show a front elevational view of a rotatable earring 10, according to one embodiment. The earring, as shown, includes: a securing member 28, in the form of a fastener 40, configured to secure the power module 26 to the coupling device 22; a battery 30, as shown in FIG. 5, configured to provide DC electricity to the earring; and an On/Off switch 32, as shown in FIG. 5, configured to control the release of power from the power module to the earring. A non-limiting example of a motor 18 causing the decorative member 20 to rotate about the elongated member 12 is described in described in U.S. Pat. No. 6,758,826 issued to Luettgen, et al, which is incorporated by reference herein. Alternative embodiments of the present invention may include securing members in the form of a magnet 42 or a clip 44, as shown in FIGS. 3 and 4, configured to securely couple the earring 10 a user's ear 24, particularly to accommodate those users without pierced ears.

According to another embodiment of the present invention, there is a light module 34 coupled to the decorative member 20 that is mechanical communication with the power module 24, and is configured to selectably provide blinking or steady light from the earring 10. A non-limiting example of the light module used to enhance the appearance of the decorative member 20, particularly during hours of darkness is described in U.S. Pat. No. 3,968,357, issued to Hamilton, which is incorporated by reference herein. Another non-limiting example of the light module may include miniature light bulbs or lamps.

In addition, the elongated member 20, as shown in FIG. 2, houses a plurality of wires and a microchip therein as part of an electric circuit. When a user securely affixes the earring to his or her ear via the securing member 28, the electric circuit that comprises the power module 26 is closed, thereby enabling the user to selectably actuate the power module in electrical communication with the DC battery-powered motor 18 via the on/off switch 32. Actuation of the power module generates kinetic energy in the motor to force the decorative member into rotational motion, as indicated by arrow 36 and/or activate the light module 34 to generate blinking or steady light.

In operation, users desiring to wear the embodiment of the rotatable earrings 10 shown in FIGS. 1 and 2 may pull the fastener 40 off of the coupling member 22; insert the coupling member 22 into their pierced ears 24; and insert coupling member through a hole 48 in the fastener, thereby securing the earring to the ear via friction between the hole and the coupling member. The user may then selectably manipulate the on/off switch 32 to actuate the decorative member into a rotational motion, as indicated by arrow 36 and/or activate the light module 34 to generate blinking or steady light to shine through the decorative member, thereby enhancing the personal appearance of users.

Embodiments of the rotatable earrings 10 would be a captivating addition to a jewelry box. The earrings are a fashionable accessory that would accentuate clothing garments. The product could be incorporated into pierced, clip-on, an/r magnetic earrings. Further, the earrings are a conversation piece that elicits a great deal of attention due to its spinning motion.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Although FIG. 1 illustrates a rotatable earring 10 affixed to a person's left ear 24, one skilled in the art would know that the earring may be affixed to a person's right ear.

Additionally, although FIG. 1 shows the decorative member 20 being in the form of a windmill, it is envisioned that the decorative member 20 may be in many different forms, designs and/or shapes, according to various embodiments. For example, hexagonal, pentagonal, square, star-shaped, etc.

It is also envisioned that effective length 46 of the elongated member 12 disposed between the motor 18 and decorative member 20 may vary, according to alternative embodiments.

It is expected that there could be numerous variations of the design of this invention. An example is that the elongated member 12; battery 18; decorative member 20; coupling member 22; securing member 28; battery 30; switch 32; light module 34; and/or securing member 28 may vary in length, width, shape, thickness, diameter, color, design, etc., according to various embodiments.

Finally, it is envisioned that the components of the device may be constructed of a variety of materials, such as plastic, aluminum, etc.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A rotatable earring for wearing and rotating, comprising:

a) an elongated member, having:

a1) a first end; and a2) a second end;

b) a motor, rotatably coupled to the first end of the elongated member, and configured to provide rotation;

c) a decorative member, coupled to the second end of the elongated member, and configured to provide decoration;

d) a coupling device, coupled to the motor, and selectably coupleable to an ear of a person; and e) a power module, coupled to the coupling device, in communication with the motor, and configured to provide power.

2. The rotatable earring of claim 1, wherein the power module comprises a securing member configured to secure the power module to the coupling device.

3. The rotatable earring of claim 2, wherein the power module comprises a battery configured to provide DC electricity.

4. The rotatable earring of claim 3, wherein the power module comprises an On/Off switch configured to control the release of power from the power module.

5. The rotatable earring of claim 4, further comprising:

a) a light module, coupled to the decorative member, in communication with the power module, and configured to provide light.

6. A rotatable earring for wearing and rotating, consisting essentially of:

a) an elongated member, having:

a1) a first end; and a2) a second end;

b) a motor, rotatably coupled to the first end of the elongated member, and configured to provide rotation;

c) a decorative member, coupled to the second end of the elongated member, and configured to provide decoration;

d) a coupling device, coupled to the motor, and selectably coupleable to an ear of a person; and e) a power module, coupled to the coupling device, in communication with the motor, and configured to provide power.

7. The rotatable earring of claim 6, wherein the power module comprises a securing member configured to secure the power module to the coupling device.

8. The rotatable earring of claim 7, wherein the power module comprises a battery configured to provide DC electricity.

9. The rotatable earring of claim 8, wherein the power module comprises an On/Off switch configured to control the release of power from the power module.

* * * * *